United States Patent [19]

Buick

[11] 4,052,886

[45] Oct. 11, 1977

[54] ENCAVITATED STEEL RULE DIE

[75] Inventor: James A. Buick, Telford, Pa.

[73] Assignee: Best Line Warehouse, Inc., Telford, Pa.

[21] Appl. No.: 697,312

[22] Filed: June 18, 1976

[51] Int. Cl.[2] ..... B31B 1/20

[52] U.S. Cl. ..... 93/58.3; 76/107 C

[58] Field of Search ..... 76/107 C, 107 R; 93/58.3, 59 R; 83/694

[56] References Cited

U.S. PATENT DOCUMENTS

| | | | |
|---|---|---|---|
| 3,109,328 | 11/1963 | Giese | 76/107 C |
| 3,322,004 | 5/1967 | Wolfe | 76/107 C |
| 3,863,550 | 2/1975 | Sarka | 76/107 C |
| 3,941,038 | 3/1976 | Bishop | 76/107 C |

*Primary Examiner*—Harold D. Whitehead
*Assistant Examiner*—Roscoe V. Parker
*Attorney, Agent, or Firm*—Miller & Prestia

[57] ABSTRACT

A cutting and scoring die useful for die-cutting or scoring paperboard or plastic materials including a solid base material that is cavernous and slotted for steel rule protrusion through the top surface thereof. The steel rule is then anchored to the base material by the use of a semi-rigid filler material.

24 Claims, 5 Drawing Figures

ENCAVITATED STEEL RULE DIE

FIELD OF THE INVENTION

The present invention relates to improved dies useful for cutting and scoring paperboard, cardboard and plastic materials so as to punch out folding carton blanks or other packaging material.

DESCRIPTION OF THE PRIOR ART

Conventionally, dies used for cutting and scoring paperboard, cardboard, and certain plastic materials have utilized steel rules arranged in a predetermined pattern between individually cut blocks called "furniture". The "furniture" is held in a steel frame or "chase" by wedges called "quoins". The operative edges of the rules extend above the blocks to adequately perform their cutting and scoring functions. Traditionally, such dies have been referred to as "block" dies.

Another conventional method for cutting and scoring paperboard, cardboard and certain plastics is the use of a "jig" die. Jig dies are made by cutting slots through a solid base material in a predetermined pattern. Steel rules are then inserted in the slots to perform the functions of cutting and scoring.

Both types of conventional dies may have a base material made of wood, metal or plastic material. The block type is normally produced with the use of a band saw or a circular saw, while the jig type can be produced by milling, routing, jig saw or laser beam.

More recently, U.S. Pat. No. 3,863,559 (Sarks et al.) has disclosed the use of a "sandwich die" for cutting and scoring paperboard material. This die includes a top and a bottom plate that have had etched therein slots representative of a predetermined cutting and scoring pattern. The two plates are spaced apart from each other by the use of welded spacer rods. Then, after the rule has been inserted into the slot, a filler material is poured between the plates to maintain the proper spacing between the plates and to hold the rule in place.

One major objective of die manufacturers and users alike is to have a die produce uniform die cut blanks throughout each and every production run. In order to achieve this result, the die must be perfectly stable and each die position must be exactly the same for each production run.

The block die can be made very accurate in each die position and it can be kept that way over the years if the wood furniture is treated and the die is kept locked up. The use of metal furniture overcomes the instability of wood but adds to the cost. Because the "funiture" consists of individually cut blocks, there can be dimensional changes when the die is re-ruled. These dies are also known to fly apart while on the press causing the production run to be shut down until the die can be reassembled.

In recent years, the jig die has been made more accurate by the use of the laser beam controlled by a N/C type machine and also by the use of a router controlled by the use of a template. Again, however, there is the instability of the wood base and the breakdown of the slots when the die is re-ruled. The use of polyurethane plastic for the base material overcomes some of the drawbacks of wood, but it needs to be locked in a chase to accurately retain the steel rule. The polyurethane base is not capable of retaining its dimensional stability when side pressure comes to bear on it as is required to hold the rule in place. This same plastic material also breaks down in the slots when the die is re-ruled.

The sandwich type die overcomes many of these aforementioned problems, but it produces some problems of its own. Expensive filler material, when poured, generates much heat, and if not carefully controlled will cause the die to warp. Although this die can be re-ruled many times, there comes a time when filler material can no longer hold the rule because a little material gets scraped off each time it is re-ruled, and it would be impossible to re-pour the die. The biggest drawback of the sandwich type die, however, is its availability and cost. Simply stated, it cannot be produced in the average shop or by conventional equipment and methods.

In many cases, after conventional dies have been re-ruled, a completely new female die counter-part must be made so as to ensure a proper mating of both male and female die members.

Therefore, an object of the present invention is to provide both an improved die and a method for manufacture of an improved die, wherein a steel rule can be retained accurately in a solid base material.

A further object of the present invention is to provide a die that accurately retains a steel rule, and does not require the application of side pressure to position the rule.

Another object of the present invention is to provide an inexpensive method that will more accurately position and retain the steel rules in existing conventional dies, i.e. the block and jig type dies, while retaining the use of present conventional equipment.

Still further, another object of the present invention is to provide an improved die and method for manufacture of an improved die wherein the steel rule is anchored in thermoplastic of thermosetting resinous filler material so that after many re-rulings, the filler material can be easily removed and new filler material repoured.

It is a more specific object to provide an improved die and method for manufacture of such an improved die that retains the steel rule in such precise alignment, wherein, even after repeated re-ruling, the existing female die counter-part can still be re-used.

SUMMARY OF THE INVENTION

These and other objects are met by the novel die and method disclosed by the present invention. Briefly, the die contemplated by this invention is made by following a cavernous region to connect two aligning slots formed in upper and lower surfaces of a unitary, substantially solid base member. A steel rule is inserted through the aligning slots so that the operative edge of the rule extends up through the uppermost slot. Then, a semi-rigid filler material is added into the cavernous region so as to anchor the steel rule in place.

The phrase "unitary, substantially solid base member" is utilized to describe a base member that is formed from a single solid element or a combination of more than one single solid elements, one element being superposed upon the other. In the latter case, the cutting or scoring edge of the rule extends up and through the uppermost portion of the base member.

Another embodiment of the present invention utilizes two base member elements, one disposed on top of the other. A slot is formed in the bottom surface of the lower base member element, while an aligning slot is formed in the top surface of the upper base member element. Then a cavity, connected to the first slot, is formed in the top portion of the lower base member element. The cavity formed in the upper base element is then superposed on the lower base element cavity. A steel rule is then placed through the aligning alots, and the cavities are filled by semi-rigid filler material so as to anchor the steel rules.

In another embodiment, an upper base element has a slot cut completely therethrough. A lower base element has an aligning slot formed in its bottom surface. A cavity, connected to the slot, is hollowed in the lower base element's top surface. The steel rule is then inserted through the aligning slots and anchored by the addition of a semi-rigid filler material to the cavernous region.

The novel method and die of the present invention will be more apparent when viewed in conjunction with the drawings wherein like reference numerals refer to similar parts and where:

DETAILED DESCRIPTION OF THE PREFERRED EMBODIMENTS

Figure 1:
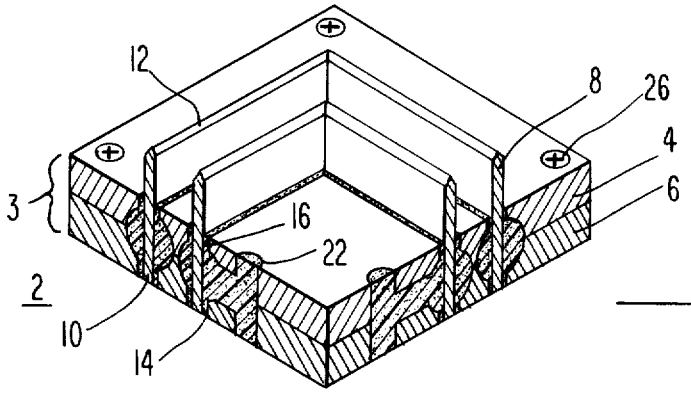
FIG. 1 is a perspective view of the preferred embodiment of the present invention.

With reference to FIG. 1, there is shown a preferred form of the invention, in which die 2 is composed of a unitary substantially solid base member 3, in turn comprising an upper base member element 4 and a lower base member element 6, in this instance made from metal or plastic material, the elements 4 and 6 being superposed on one another. Die 2 includes steel rules 8 having base edges 10 and operative edges 12. Lower base element 6 has slots 14 formed in the bottom surface portion thereof, while upper base element 4 contains slots 16 that align with slots 14 forming a predetermined pattern in which the desired paperboard or plastic material will be cut and scored.

In this embodiment and in all others, the slots may be formed by the use of a jig saw, laser beam or by conventional routing and milling methods.

Figure 2:
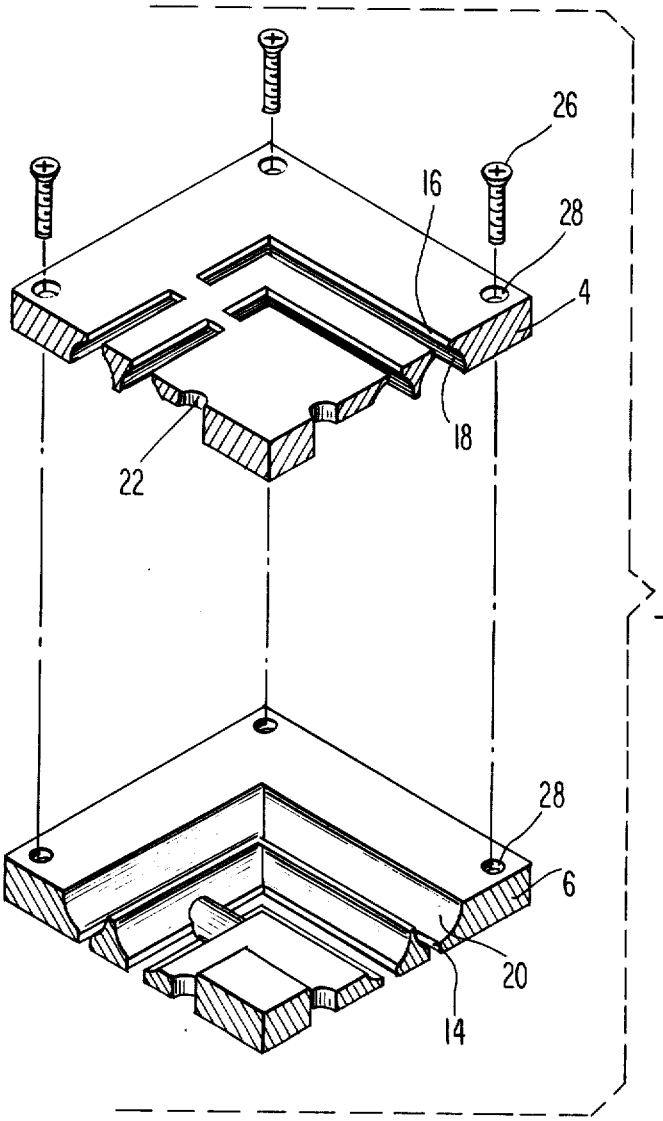
FIG. 2 is an exploded view of the preferred embodiment of the present invention showing the manner in which the upper and lower base elements are aligned.

As may be seen in FIG. 2, cavities are formed in the bottom portion of the upper base element 4 and in the top portion of lower base element 6. These cavities form an opening through the bottom portion of the upper base and the top portion of the lower base respectively. Cavities 18, formed in the upper base member element are made by using a router, milling or other suitable standard tool. Lower base member cavities 20 are then formed in similar fashion. As may be seen, cavities 18, 20 are formed between aligning slots 14, 16. Cavities 18 are connected to slots 16, while cavities 20 are connected to slots 14. In this embodiment, cavities 18 are formed by hollowing the upper base material element from the bottom surface portion thereof. Cavities 20 are formed by hollowing the lower base member element 6 from the top side portion of the lower base.

The top side portion of lower base element 6 and the bottom side portion of upper base element 4 are treated with a mold release agent for reasons that shall hereinafter be explained. Also, steel rules 8 are similar treated with the mold release agent.

Steel rules 7 are placed through slots 14, 16 in such a manner that base edges 10 are placed in slots 14, while operative edges 12 extend upwardly through slots 16. Filler holes 22, connected to the cavities, are established along the cavities to provide for entry of the filler material into the cavernous sections.

Next, the filler material is added through filler holes 22 to anchor the rules in place. For filler material, one may employ epoxy resin or any other thermosplastic or thermosetting resin material that is capable of being cured to a semi-rigid structure. The term "semi-rigid" is used to describe a filler material that exhibits a degree of resiliency, yet still is capable of adequately anchoring or supporting the steel rule. Preferably, a small amount of polysulfide rubber is mixed with the epoxy resin. Such an addition of polysulfide rubber to the epoxy resin permits the filler material to have a small degree of resiliency while providing adequate support and holding power for the steel rules.

Fastening screws 26 fitting through upper base element 4 and lower base element 6 are threadably engaged in threaded orifices 28 formed in both the upper base element 4 and lower base element 6 to provide a flush mating of the two base elements.

The use of the mold release agent on the mating surfaces of the upper and lower base elements allows for an easier cleaning of the bases after the filling material has cured. The rules 8 are similarly treated with the mold release agent so that the rule may be able to break free of the filler material so that the rules can be levelled when the die is on the press. Also, the use of such a mold release agent on the rules allows the die to be re-ruled as required in its future commercial use.

Figure 3:
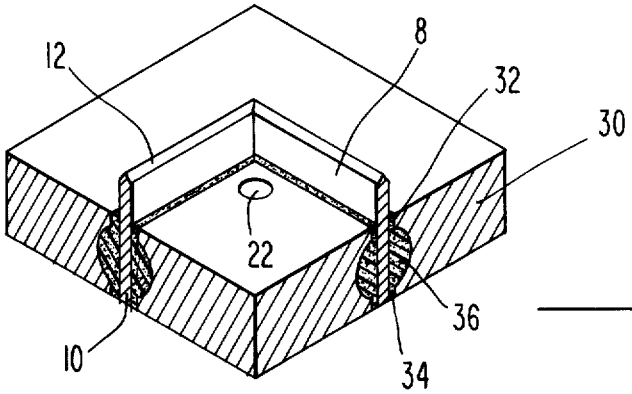
FIG. 3 is a perspective view of another embodiment of the present invention.

FIG. 3 illustrates the embodiment of the present invention preferred for use with a fiberglass reinforced polyurethane material. Here, only one base member element 30 is utilized, with aligning slots 32, 34 being formed in the top and bottom portions thereof respectively. Cavity 36 connects both of the slots to define a central passage. In this embodiment, a long routing bit is used to make the hollow cavity 36 along the slotted areas by entering in from the edges of the base member.

Figure 4:
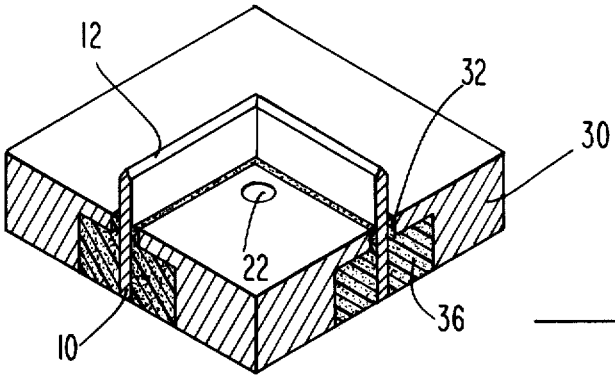
FIG. 4 is a perspective view of a third embodiment of the present invention.

FIG. 4 again employs only a single base member element 30. Base member 30 has slot 32 formed in the top surface thereof. The cavity 36 is produced by using a router, dado blade, or other standard tool. Once again, the cavity and slot define a passage through which the steel rule will be inserted. In this embodiment, there is no need to form a bottom surface slot on the base member, as the cavity 36 is hollowed by entering from the bottom surface. This embodiment is useful when it is desirable to have base members made from wood or polyurethane.

Figure 5:
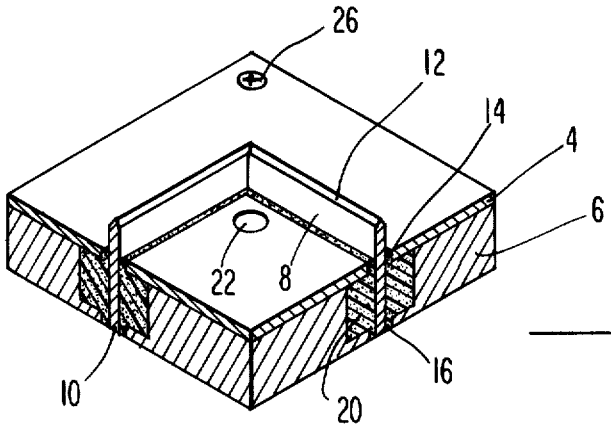
FIG. 5 is a perspective view of a fourth embodiment of the present invention.

FIG. 5 illustrates yet another embodiment of the present invention that is preferred when a rotary die base member made from wood, metal or plastic is desired. In this instance, the die includes upper base member element 4 and lower base member 6. Upper base member element 4 contains slot 14 cut completely therethrough. Lower base member element 6 includes slot 16 in the bottom surface thereof adapted to align with slot 14. Cavity 20, communicating with slot 14, forms a passage through which the rule will be inerted. The cavity, in this embodiment, is formed by hollowing the lower base element from the top side portion thereof, thus forming an opening in the top side portion of the lower base member element. Filler hole 22 communicates with the cavity so that the filler material may be added therethrough. Fastening screw 26 is threaded through a threaded orifice found in both the upper base and lower base elements (not shown) to provide for a flush and tight mate of upper base 4 to lower base 6.

It will be understood that the representations of the finished dies illustrated in FIGS. 1 through 5 are not intended to exemplify an actual pattern of assembled cutting and creasing rules such as would be employed in practice in die cutting paperboard or plastic material to the desired configurations for folding cartons or packaging materials. These drawings have been simplified to facilitate the description of the manufacturing process and the resulting die structures.

For its intended use, the finished die is mounted on the cutting press in the customary manner, in superposiston to an opposing press member. Typically, on a flat bed press, the opposing member will be a back up plate having a covering of hard counter paper. By bringing the back up plate into contact with the cutting and scoring die, an impression will be formed in the counter paper corresponding to the pattern arrangement of the cutting and scoring rules. The impressed areas of the counter paper are then removed, providing thereby in the counter paper a female counterpart of the male pattern arrangement of the rules in the cutting and scoring die. The press is then ready to perform its function of die-cutting paperboard fed thereto.

Becasue of the semi-rigid and precise vertical positioning of the rules in the die, in contradistinction to that experienced with conventional die assemblies, the number of impressions that can be made in die cutting paperboard is more than doubled. This also causes the female counter to have a longer life, and therefore reduces press down time.

While the die of the present invention finds its most useful application in the cutting and scoring of paperboard such as is used in the manufacturing of folding carton blanks, its use is not limited thereto. Certain of the advantages of the novel die, including accuracy and repeatability of the geometric pattern design, are likewise obtained in cutting and scoring of corrugated paperboard box blanks, plastic sheets and films, metal foil and the like material.

The advantages of the die of the present invention result principally from the following features:

1. Dimensional stability in the operating environment, substantially unimpaired by conditions of temperature, humidity, etcetera.

2. Durability for the die base structure which enables repeated re-ruling and other handling without impairment of the accuracy or positioning of the steel rules. The worn or damaged steel rules are pulled from the die base and pre-bent rules are reinserted into the same slots.

3. Increased steel rule life is a result of precise vertical placement of the rules and their freedom from loosening or displacement.

4. Die bases require little or no side pressure in the chase to keep the steel rule from falling out, thus eliminating distortions of the pattern design.

5. The many individual blocks of a block type die are now a unitary and continuous base preventing the die from falling apart. This is due to the adherent qualities of the epoxy resin.

6. In all preferred applications the filler material can be removed and the die repoured, allowing an almost infinite useful die life.

7. The stabilizing effect derived from this novel invention allows for the use of fixed stable female counters on all conventional type dies, giving paperboard converters a higher degree of accuracy and uniformity in the carton blanks that are die cut.

8. Conventional methods and equipment are employed to manufacture dies using this method of anchoring the steel rule, thus making it possible for the local die shops to produce stable dies for the industry without having to invest in specialized equipment and technology.

9. Stable materials such as all metal or all fiberglass reinforced polyurethane can be enmployed for use as a die base material due to the holding power of the filler material holding the steel rule in place.

10. Conventional type dies achieve the advantage of the sandwich type dies yet incur less of the expensive filler material and the inherent problems associated with a high volume mass of the epoxy resin.

Although this invention has been described in connection with specific forms thereof, and with respect to specific steps of the methods herein involved, it will be appreciated that a wide variety of equivalents may be substituted for those specific elements shown and described herein, that certain features may be used independently of other features, and that certain parts and method steps may be reversed, all without departing from the spirit and scope of this invention as defined in the appended claims.

I claim:

1. A die used for cutting and scoring paperboard and plastic material comprising:

a. a unitary, substantially solid base member having at least one slot cut in a surface thereof;

b. a steel rule having a base edge and an operative edge;

c. a cavity formed in said base member to communicate with said slot, said slot and said cavity defining a passage through which said rule is inserted so that said operative edge of said rule extends up through the top surface of said base member;

d. semi-rigid filling material filling said cavity, said semi-rigid material filling said cavity adapted to anchor said steel rule to said base member by engaging the opposed surfaces of said rule and said cavity substantially throughout the surface areas of said opposed surfaces.

2. A die as recited in claim 1, further including a filler hole formed in the upper surface of said base member, said hole connected to said cavity and being adapted to provide a source for filling said cavity with said semi-rigid material.

3. A die as recited in claim 1, wherein said semi-rigid material is a mixture of an epoxy resin and polysulfide rubber.

4. A die used for cutting and scoring paperboard and plastic material comprising:

a. a lower base member element having a slot formed in the bottom surface thereof;

b. an upper base member element having a slot formed in the top surface thereof adapted to align with said lower base slot;

c. a cavity located in the top surface of said lower base element, said cavity being connected to said first slot;

d. a cavity located in the bottom surface of said upper base element, said cavity being connected to said second slot, said upper base element cavity superposed on said lower base element cavity;

e. a steel rule having a base edge and an operative edge, said base edge placed in said lower base element slot, said operative edge extending up through said upper base element slot; and f. semi-rigid filling material filling said cavities, said semi-rigid material adapted to anchor said steel rule to said bases.

5. A die as recited in claim 4, further including a filler hole bored through said upper base element and communicating with both of said cavities, said hole being adapted to provide a source for filling said cavity with said semi-rigid material.

6. A die, as recited in claim 4, further including in combination a fastening screw and threaded orifices, said orifices being bored in said upper and lower base elements, said screw threadably engaged in said orifices.

7. A die as recited in claim 4, wherein said base elements are metal.

8. A die as recited in claim 4, wherein said base elements are wood.

9. A die as recited in claim 4, wherein said base elements are plastics.

10. A die as recited in claim 4, wherein said base elements are fiberglass reinforced polyurethane.

11. A die as recited in claim 4, wherein said semirigid material is a mixture of an epoxy resin and a polysulfide composition.

12. A die for cutting and scoring paperboard material comprising:

a. an upper base member element having a slot formed therethrough;

b. a lower base member element having a slot formed in the bottom portion thereof; said lower base element slot adapted to align with said upper base element slot;

c. a cavity formed in the top portion of said lower base element connected to said second slot and located between said aligning slots;

d. a steel rule having a base edge and an operative edge, said base edge placed in said slot formed in said lower base element, said operative edge extending up through said upper base element slot; and e. semi-rigid filler material filling said cavity, said semi-rigid material adapted to anchor said steel rule to said lower base element.

13. A die as recited in claim 12, wherein said semirigid filler material is a mixture of an epoxy resin and polysulfide rubber.

14. A die for cutting and scoring paperboard material comprising;

a. a steel rule having an operative edge and a base edge;

b. a base member having a slot formed into the top surface thereof;

c. a cavity formed in the lower surface of said base member, said cavity aligning with said slot, said cavity and said slot defining a passage through which said rule extends so that said operative edge of said rule extends upwardly through said slot; and d. semi-rigid filler material filling said cavity, said semi-rigid material adapted to anchor said steel rule to said lower base.

15. A die as recited in claim 14, wherein said semirigid filler material is a mixture of an epoxy resin and polysulfide rubber.

16. A die for cutting said scoring paperboard material comprising:

a. a steel rule having an operative edge and a base edge;

b. a base member having aligned slots formed in the top and bottom surfaces thereof;

c. a cavity formed in said base member intermediate said aligned top and bottom slots and in communication therewith, said slots and said cavity defining a passage through which said rule extends so that said operative edge of said rule extends upwardly through said slot; and d. semi-rigid filler material filling said cavity, said semi-rigid material adapted to anchor said steel rule to said lower base.

17. A die as recited in claim 16, wherein said semirigid filler material is a mixture of an epoxy resin and polysulfide rubber.

18. A method for forming a die to be used in cutting and scoring of paperboard or plastic material comprising the steps of:

a. forming aligning slots in the top and bottom portion of a base member;

b. forming a cavity between and connected to said slots by hollowing said base member from an edgewise portion thereof;

c. inserting a steel rule in said slots so that the operative edge of said rule extends upwardly through said slot formed in the top portion of said base member; and d. placing a semi-rigid filler material into said cavity to anchor said steel rule.

19. A method for forming a die to be used in cutting and scoring of paperboard and plastic material comprising the steps of:

a. forming a slot in the top side portion of an upper base member element;

b. forming a slot in the bottom side portion of a lower base member element to align with said first slot;

c. forming a cavity in the bottom portion of said upper base member element to communicate with said first slot, said cavity forming an opening in the bottom surface of said upper base member element;

d. forming a second cavity in the top side portion of said lower base member element to communicate with said second slot, said second cavity forming an opening in the top surface of said lower base member element;

e. superposing said upper base element cavity on said lower base element cavity;

f. inserting a steel rule through said slots so that the operative edge of said rule extends upwardly through said first slot; and g. placing a semi-rigid filler material in said cavities to anchor said steel rule.

20. A method as recited in claim 19, wherein said lower base element cavity is formed by hollowing said lower base member element from the top portion thereof.

21. A method as recited in claim 20, wherein said upper base element cavity is formed by hollowing said upper base member element from the bottom side thereof.

22. A method for forming a die to be used in cutting and scoring paperboard and plastic material comprising the steps of:

a. forming a slot through an upper base member element;

b. forming a slot in the bottom side surface of a lower base member element to align with said first slot;

c. forming a cavity in the top surface of said lower base member element to communicate with said second slot, said cavity forming an opening in the top surface of said lower base member element;

d. placing said upper base member element on top of said lower base member element in such a manner as to cause alignment of said slots;

e. inserting a steel rule in said slots so that the operative edge of said rule extends upwardly through said first slot; and f. placing a semi-rigid filler material in said cavity to anchor said steel rule.

23. A method as recited in claim 22, wherein said cavity is formed by hollowing said lower base member element from the top side portion thereof.

24. A method for forming a die to be used in cutting and scoring of paperboard or plastic material comprising the steps of:

a. forming slots in the top portion of said base member;

b. forming a cavity aligned with said slots by hollowing said base member fromm the bottom surface thereof;

c. inserting a steel rule in said slots so that the operative edge of said rule extends upwardly through said slot formed in the top portion of said base member; and d. placing a semi-rigid filler material into said cavity and substantially filling said cavity to anchor said steel rule therein.

* * * * *